US006270187B1

(12) United States Patent
Murcia et al.

(10) Patent No.: US 6,270,187 B1
(45) Date of Patent: Aug. 7, 2001

(54) METHOD AND APPARATUS FOR HIDING ERRORS IN SINGLE-PASS INCREMENTAL PRINTING

(75) Inventors: Antonio Murcia; Xavier Bruch; Chris Taylor; Xavier Girones; Lluís Vinals, all of Sant Cugat del Valles (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/211,713

(22) Filed: Dec. 14, 1998

(51) Int. Cl.[7] ..... B41J 2/21; B41J 23/00
(52) U.S. Cl. ..... 347/43; 347/37
(58) Field of Search ..... 347/43, 37, 41, 347/19

(56) References Cited

U.S. PATENT DOCUMENTS

| | | | | |
|---|---|---|---|---|
| 5,109,239 | | 4/1992 | Cobbs et al. | 346/140 R |
| 5,124,720 | | 6/1992 | Schantz | 346/1.1 |
| 5,430,306 | | 7/1995 | Hanno, IX | 347/573 |
| 5,581,284 | * | 12/1996 | Hermanson | 347/43 |
| 5,587,730 | * | 12/1996 | Karz | 347/43 |
| 5,680,519 | | 10/1997 | Neff | 395/109 |
| 5,764,254 | | 6/1998 | Nicoloff et al. | 347/43 |
| 5,905,517 | * | 5/1999 | Siverbrook | 347/61 |
| 6,010,205 | * | 1/2000 | Billet | 347/40 |
| 6,039,438 | * | 3/2000 | Beerling | 347/63 |
| 6,089,695 | * | 7/2000 | Takagi et al. | 347/40 |

FOREIGN PATENT DOCUMENTS

| | | | |
|---|---|---|---|
| 0694396 | 1/1996 | (EP) | B41J/2/07 |
| 0855270 | 7/1998 | (EP) | B41J/2/04 |
| 63-067164 | 3/1988 | (JP) | B41J/3/20 |
| 07314737 | 12/1995 | (JP) | B41J/2/255 |
| WO9908875 | 2/1999 | (WO) | B41J/2/05 |

* cited by examiner

*Primary Examiner*—Thinh Nguyen
(74) *Attorney, Agent, or Firm*—Ashen & Lippman

(57) ABSTRACT

It is first determined whether any printing element of a printhead has failed. If so, functions of the failed element are reassigned to other elements. Some aspects of the invention do this in such a way as to maintain essentially single-pass operation. Ordinarily the reassigned functions are applied to control operation of the head or heads, to print images on a print medium, and functions of the apparatus and method are effected automatically by program instructions—in nonvolatile memory. One approach to the reassignment includes removing from service all printing elements between the failed element and a nearer end of the head, inclusive—and then preferably operating all remaining in-service elements as a shorter printhead. If the printhead operates in conjunction with a print-medium advance mechanism, then also preferably each operation of that mechanism is shortened to correspond to a height of the shorter head. Another approach, if the failed element is in a black printhead and the printer has three or more subtractive-primary-color heads, includes assigning a corresponding printing element of each of those color heads, in combination, to print in lieu of the failed black-printing element. Yet another approach—if the printer has other heads that print the same color as the failed element—is assigning a corresponding element of one or more of those heads to stand in for the failed element. Still another approach includes assigning a printing element near (preferably next to) the failed element.

21 Claims, 6 Drawing Sheets

FIG. 1
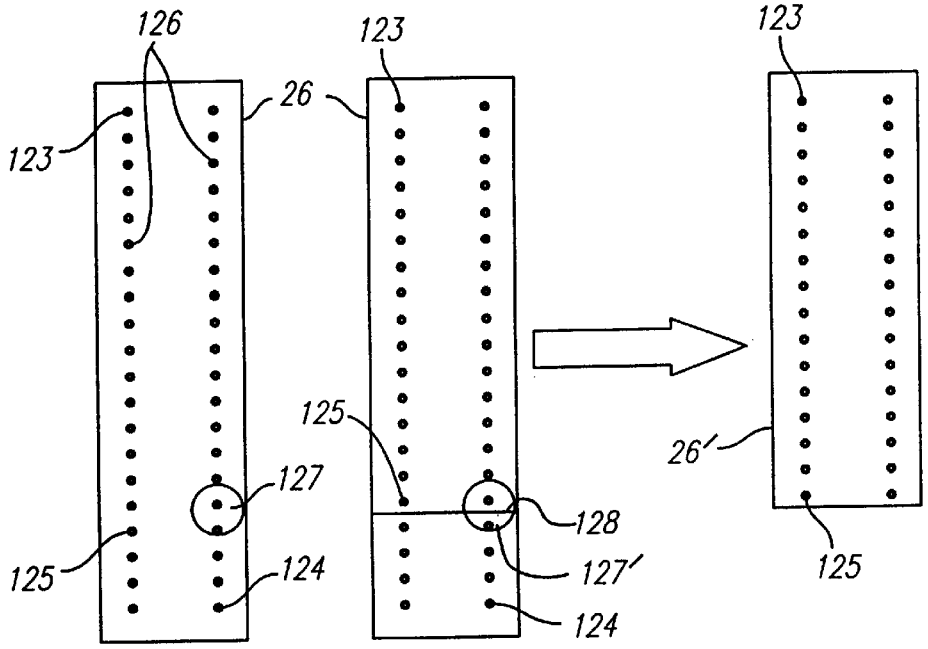
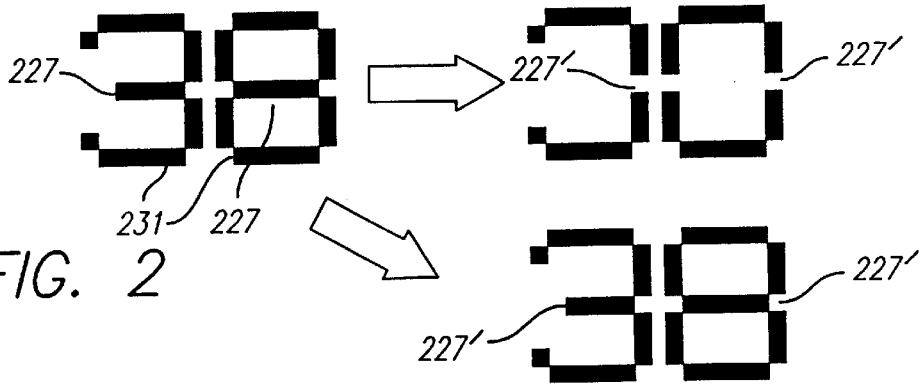
FIG. 2
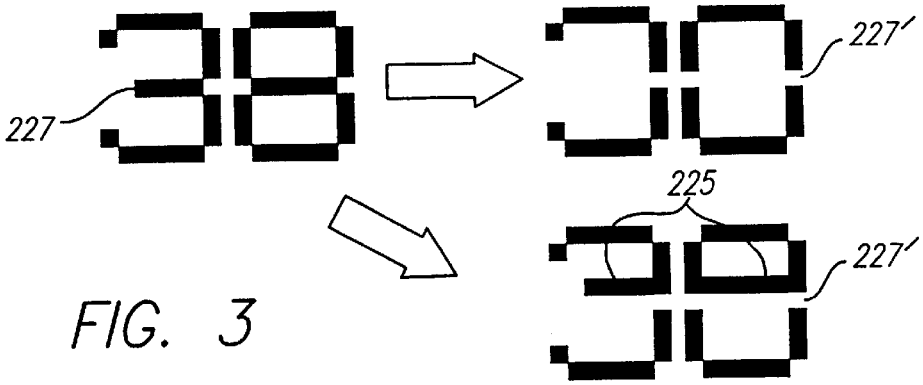
FIG. 3

METHOD AND APPARATUS FOR HIDING ERRORS IN SINGLE-PASS INCREMENTAL PRINTING

RELATED PATENT DOCUMENTS

Related documents are other, coowned United States utility patents and applications identified below—and all hereby incorporated by reference in their entirety into this document. Three are U.S. Pat. No. 5,430,306, in the name of Hanno Ix, Ph. D.; U.S. Pat. No. 5,764,254 in the names of Nicholas Nicoloff, Jr., et al.; and U.S. Pat. No. 5,109,239 of Cobbs et al. Other such documents are copending U. S. applications. These include Ser. No. 08/811,412, in the names of Chris T. Armijo et al., Ser. No. 08/665,777 of Jack H. Schmidt, which has now issued as U.S. Pat. No. 6,088,134; and also Ser. No. 09/183,819 of Thomas H. Baker. Yet another is in the names of Xavier Bruch et al. and entitled "METHOD FOR DETECTING DROPS IN PRINTER DEVICE"—filed generally concurrently with the present document, subsequently assigned Ser. No. 09/502,667.

FIELD OF THE INVENTION

This invention relates generally to machines and procedures for printing text or graphics on printing media such as paper, transparency stock, or other glossy media; and more particularly to a scanning machine (such as, merely by way of example, a thermal-inkjet printer) and method that construct text or images from individual colorant spots created on a printing medium, in a two-dimensional pixel array. The invention employs print-mode techniques to retain the throughput advantages of single-pass printing with minimal sacrifice of image quality.

BACKGROUND OF THE INVENTION

In recent years, very extensive and elaborate refinements have been introduced to the art of multipass printing with incremental machines and methods—but in this innovative process the earlier and simpler single-pass art has been somewhat left by the wayside. Yet the benefits of single-pass printing remain important for special applications such as all-text documents—and also drafts of more complex documents. Documents printed in this way include not only letters, manuscripts, commercial advertising papers and the like, but also small items such as labels, bar codes, small receipts, credit-card charge authorizations and ATM (automatic teller machine) information slips.

Incremental printing employs individual pixel-forming devices. These take the form of thermal-inkjet nozzles, for example, or dot-matrix printing pins, or the individual heater elements of thermal-printer heads—including small units such as are used in printing the small commercial slips mentioned above.

In this document all such individual pixel-forming devices are called "printing elements" or "individual printing elements". The aggregation of printing elements is called a "printhead" or a "multiple-printing-element printhead".

One weakness of incremental printing is that the individual printing elements sometimes fail, leaving some areas of a text page or a drawing with no colorant deposited—and thereby omitting information from the image. In some cases such malfunctions can produce aesthetic defects, in other cases difficulty of reading alphanumeric characters or making out small details in a picture, and in still other cases actual loss of intelligence in numerical data, bar code lines, and the like.

Such errors may for instance include omission of crossbars in alphanumeric characters—thereby causing a numeral "8", for example, to appear as a "0". Analogously entire lines may be omitted from diagrams, e. g. floor plans—whereby for instance an entire wall between rooms may vanish. In such diagrams it is desirable to try to avoid such problems by setting the minimum line width to two pixels, but even this stratagem may be inadequate as sometimes two printing elements in a row fail.

Basically all such errors can be eliminated or concealed only by pressing into service some backup nozzle, pin, heater etc. that is functioning. Previous algorithmic efforts along these lines have resorted to multipass or at least plural-pass modes—implying that at least two different nozzles or pins must be made available to print on each pixel row of the image.

A fundamental problem with such techniques is that throughput is severely degraded by switching to plural-pass modes. In particular if a printing system detects just one single printing element malfunctioning, in accordance with the described technique the deficit can be overcome only by changing to a printing mode of at least two lasses.

In other words, throughput in terms of area covered per scan (i. e., per reciprocation of the scanning carriage) must be cut in half to accommodate a loss of only one printing element, even though for example an inkjet pen may have, say, two hundred to twelve hundred nozzles. Plainly a fifty-percent throughput loss is disproportionate to a 1/12 of one percent or ½ of one percent loss in nozzle complement.

Even dot-matrix machines may typically have more than twenty-four pins. In this case if one pin fails, the result is a fifty-percent throughput loss for approximately a four-percent pin failure—still severely out of proportion.

Conclusion—The established techniques accordingly have continued to impede achievement of high-throughput, reasonably high-quality text or draft printing. Thus important aspects of the technology used in the field of the invention remain amenable to useful refinement.

SUMMARY OF THE DISCLOSURE

The present invention introduces such refinement. In its preferred embodiments, the present invention has plural aspects or facets that can be used independently, although they are preferably employed together to optimize their benefits.

In preferred embodiments of a first of its facets or aspects, the invention is a method of printing desired images on a printing medium. The method operates by construction of the images from individual marks.

These marks are formed by at least one scanning multiple-printing-element printhead that operates in substantially a single-pass mode of operation. (Those skilled in the art will understand that the printhead may be capable of operation in a multipass mode too, but for purposes of applying the present invention the printhead is assumed to be operating in a single-pass mode at the outset.)

The method includes the step of determining whether any printing element of the printhead has failed. In addition the method includes the further step of—if a printing element has failed—then reassigning functions of the failed printing element to other printing elements.

In accordance with the invention, this reassigning step is performed in such a way as to maintain the substantially single-pass mode of operation. Of course some exemplary ways of performing the reassigning step to satisfy this condition are introduced below.

In the foregoing discussion the word "substantially" has been included to allow for the possibility of an occasional or incidental multiple-pass operation. Such an operation may be inserted for example merely in an effort to design around the present patent document—or perhaps for some more benign purpose.

The foregoing may constitute a description or definition of the first facet of the invention in its broadest or most general form. Even in this general form, however, it can be seen that this aspect of the invention significantly mitigates the difficulties left unresolved in the art.

In particular, by maintaining substantially single-pass operation, the invention can often or usually avoid the drastically disproportionate throughput loss described in the preceding section of this document. In certain situations some throughput loss is suffered, but often that loss is much less severely disproportionate to the fractional loss in printing-element complement.

Although this aspect of the invention in its broad form thus represents a significant advance in the art, it is preferably practiced in conjunction with certain other features or characteristics that further enhance enjoyment of overall benefits.

For example, a first preference is that the reassigning step include removing from service all printing elements between the failed printing element and a nearer end of the printhead, inclusive. The rationale behind this strategy flows from these observations:

(1) printing elements most commonly do not fail;

(2) when printing-element failure occurs, most often only one element fails;

(3) when more than one printing element fails, the failed elements are sometimes (perhaps even more often than not) near one another, rather than widely separated; and (4) when printing elements fail, elements near one or the other end of a printing-element array fail more often than elements near the center.

The stated strategy exploits these facts to form—in a great majority of printing-element failures—a residual, operable printhead that is, in a best-case situation, merely somewhat shorter. The result is no departure from single-pass printing, and only a slight degradation of throughput.

If only one printing element fails, then in the worst-case situation the failed element is close to the center of the array. Unless the failed element is precisely at the center, the residual printhead is still slightly longer than half the original printhead, thus leading to at least slightly better throughput than would be obtained with a two-pass mode.

Accordingly, if the first preference is followed, it is further preferred that the reassigning step also include the step of then operating all remaining in-service printing elements as a shorter printhead—as if the head or pen were trimmed or "cropped".

Accordingly for this particular tactic the shorthand term "pen crop" is used in this document. Also preferably, if the pen-crop method is used with a printhead that operates in conjunction with a printing-medium advance mechanism, the method also includes shortening each operation of the printing-medium advance mechanism to correspond to a height of the shorter printhead.

A second preference, still relating to the first main independent aspect of the invention, is for use in a printer that has a black printhead and at least three primary-color printheads. Also, it is for use only when a failed printing element is a printing element of the black printhead.

In this case the reassigning step includes assigning a corresponding printing element of each of at least three primary-color printheads, in combination, to print in lieu of the failed printing element of the black printhead. The point here is to print in so-called "composite black"—i. e., substituting superimposed pixels of three subtractive primaries for pixels of true black—when a true-black printing element has failed.

The preceding paragraph includes the phrase "at least" because some printing systems and methods operate with plural dilutions or intensities of one or more colorants. In such a system the chromatic constituents of the composite black may include more than one such dilution or intensity for one or more of the chromatic colorants.

This particular preferred method is beneficial in that a black field printed with an only-occasional or isolated single pixel row in composite black is nearly indistinguishable from the same field printed uniformly in true black. The alternative of leaving the same occasional rows unprinted is by comparison far less satisfactory.

Again, no departure from single-pass printing is required. Those skilled in the art will recognize that many previous innovations have employed and elaborated upon the substitution of composite for true black, and vice versa, for various different purposes—but never for the purpose of maintaining single-pass operation to circumvent failure of a true-black printing element.

A third preference, also relative to the first main facet of the invention, is for use in a printer that has plural printheads that print in a certain base color. By the phrase "base color" is meant to encompass either (1) black or (2) a certain one of the chromatic colors in which the printer can print—i. e., most typically cyan, yellow or magenta. Also, this preference is for use only when a failed printing element is a printing element of a particular one of the printheads which prints in that certain base color.

This situation of plural printheads printing in a certain base color arises, for instance, in printers that print using respective plural colorant dilutions or intensities. It also arises in wide-bed printer/plotters having plural scanning carriages—operating, for example, across respective different plural segments of the image. The latter sort of system may have plural printhead carriages that run either along plural carriage-support/guide systems that are separate, or along a generally common support/guide system.

In the case of this third preference, the reassigning step includes assigning at least one corresponding non-failed printing element of a printhead that prints in the certain base color—but one other than the particular one—to print in lieu of the failed printing element of the particular printhead. The point here is to print in the same base color using—merely by way of example—an inaccurate colorant dilution, or a printhead that must be diverted from its usually-different image segment to cover for the failed printing element.

The preceding paragraph includes the phrase "at least" because in some plural-dilution or plural-intensity cases it may be helpful to most closely approximate the dilution or intensity associated with the failed element by a sum of two or more dilutions or intensities available for the particular pixel row. Analogously it may be desirable to cover with more than one printhead that is ordinarily associated with a different guide/support system. Furthermore combinations of these two kinds of plural-certain-base-color-printhead substitutions, if available, may be pressed into service.

This particular preferred method is beneficial in that a field printed in the certain base color with an only-occasional or isolated single pixel row in an incorrect dilution or intensity is nearly indistinguishable from the same field printed uniformly in the correct dilution.

Analogously, if the failed printing element is to be invoked only occasionally in a particular image, a field printed in the certain base color with the resulting only-occasional diversion of a printhead from a different guide/support segment is colorimetrically accurate and less disruptive of throughput.

The alternative of leaving the same occasional rows unprinted is by comparison far less satisfactory. Again, no departure from single-pass printing is required, and this substitution is not limited to failed elements that print in black.

In a fourth preference, still relative to the first main facet of the invention, the reassigning step includes assigning a printing element near the failed printing element, to print in lieu of the failed printing element. Although this "nearby substitution" preference is perhaps the least satisfactory of the three, in terms of image quality, it is also the one that is most likely to be available.

That is to say, it is available even when the failed element is near the middle of the array, and even if no color elements are available in the apparatus for printing composite black, and even if there is no other same-base-color printhead. If this fourth preference is employed, ideally the printing element "near" the failed printing element is one which is immediately adjacent to the failed printing element.

In preferred embodiments of the second aspect of the invention, the invention is apparatus for printing desired images on a printing medium. The apparatus operates by construction from individual marks formed by at least one scanning multiple-printing-element printhead.

The apparatus includes some means for determining whether any printing element of the printhead has failed. For purposes of breadth and generality in discussing the invention, these means will be called simply the "determining means".

The apparatus also includes some means for use only if a printing element has failed. These means then reassign functions of the failed printing element to other printing elements—in such a way as to maintain the substantially single-pass mode of operation. Again for generality and breadth, these means will be called the "reassigning means".

The foregoing may constitute a description or definition of the second facet of the invention in its broadest or most general form. Even in this general form, however, it can be seen that this aspect, too, of the invention significantly mitigates the difficulties left unresolved in the art.

In particular, the benefits and also the preferences associated with this aspect of the invention closely parallel those of the method facet first discussed above. As to preferences for example, it is preferred that the reassigning means comprise some means for removing from service all printing elements between the failed printing element and a nearer end of the printhead, inclusive; and if this is done then it is also preferred that the reassigning means further include means for then operating all remaining in-service printing elements as a shorter printhead.

In its remaining basic aspects or facets presented below, as in the first, the invention is a method of printing desired images on a printing medium, by construction from individual marks formed by at least one scanning multiple-printing-element printhead. In all of these remaining aspects, the method includes the step of determining whether any printing element of a particular printhead—or type of printhead—has failed, and also a backup step to be used if a printing element has failed.

In its third main aspect, the backup step includes removing from service all printing elements between the failed printing element and a nearer end of the printhead, inclusive. The foregoing may be a description or definition of the third aspect of the invention in its most general or broad terms.

As will be understood, this third main facet of the invention has benefits closely related to those described earlier for the first preference of the first main aspect of the invention. This third facet, however, is not necessarily restricted to use with a single-pass system or method—or to use in maintaining the benefits of a single-pass system or method.

Subsidiary preferences mentioned earlier are applicable here too. Thus for instance it is preferred that the removing step further include the step of then operating all remaining in-service printing elements as a shorter printhead. If this is done, and if a printing-medium advance mechanism is in use, the method further preferably includes the step of shortening each operation of the printing-medium advance mechanism to correspond to a height of the shorter printhead.

In preferred embodiments of a fourth of its aspects, the inventive method is for use in a printer that has a black printhead and at least three primary-color printheads. In this case the determining step relates only to black printheads, and the backup step is assigning a corresponding printing element of each of at least three primary-color printheads, in combination, to print in lieu of the failed printing element of a black printhead.

The reason for inclusion of the phrase "at least" in this description is as explained earlier for the second preference of the first main aspect of the invention. Advantages of this fourth aspect of the invention include ability to maintain a single-pass printing mode without sacrificing any other printing elements as is done in the third facet of the invention—but also without noticeably degrading the appearance of occasional black pixel rows whose true-black printing element has failed.

In preferred embodiments of a fifth of its aspects, the inventive method is for use in a printer that has plural printheads that all print in a certain base color. Here the determining step relates only to printheads that print in that base color, and the backup step is assigning at least one corresponding nonfailed printing element of a printhead that prints in the certain base color—other than the particular printhead—to print in lieu of the failed printing element of the particular printhead.

The reason for inclusion of the phrase "at least" in this description is as explained earlier for the third preference of the first main aspect of the invention. Advantages of this fifth aspect of the invention are analogous to those discussed above for that third preference of the first main aspect—but also without noticeably degrading the appearance of occasional pixel rows of the certain base color whose routinely assigned printing element has failed.

As to preferred embodiments of a sixth of its aspects, the backup step is assigning a nearby printing element to print in lieu of the failed printing element. Advantages of this sixth facet of the invention include the ability to avoid plural-pass operation without sacrificing other printing elements.

The sixth facet of the invention provides such capability even if the system has no additional color printing capability (such as would be needed for the composite-black printing of the fourth aspect of the invention), and even if the system has no redundant same-base-color printhead. This sixth facet of the invention is also particularly useful for small label printers and the like, which make only one pass for the entire document.

Although the sixth aspect of the invention, like those discussed above, thus constitutes a significant advance in the art, nevertheless it too is preferably practiced in conjunction with other features and characteristics that optimize enjoyment of its benefit. For example, preferably the nearby printing element is a printing element immediately adjacent to the failed printing element: this preference maximizes the appearance of the printed image.

All of the foregoing operational principles and advantages of the present invention will be more fully appreciated upon consideration of the following detailed description, with reference to the appended drawings, of which:

BRIEF DESCRIPTION OF THE DRAWINGS

FIG. 1 is a highly schematic plan of a multiple-printing-element printhead with a single failed printing element, illustrating the "pen crop" strategies of the invention;

FIG. 2 is a schematic representation of numerals for printing using a familiar, highly utilitarian and simple, coarse pixel font or character-forming pattern—and showing how such numerals may appear if a particular pixel row fails, but also showing how such numerals may be reconstructed using either the "composite black" or "plural-same-base-color-printhead" techniques of the invention;

FIG. 3 is a like representation but snowing instead how such numerals may be reconstructed using the "forced misdirection" or "nearby substitution" tactics of the invention;

DETAILED DESCRIPTION OF THE PREFERRED EMBODIMENTS

Figure 4:
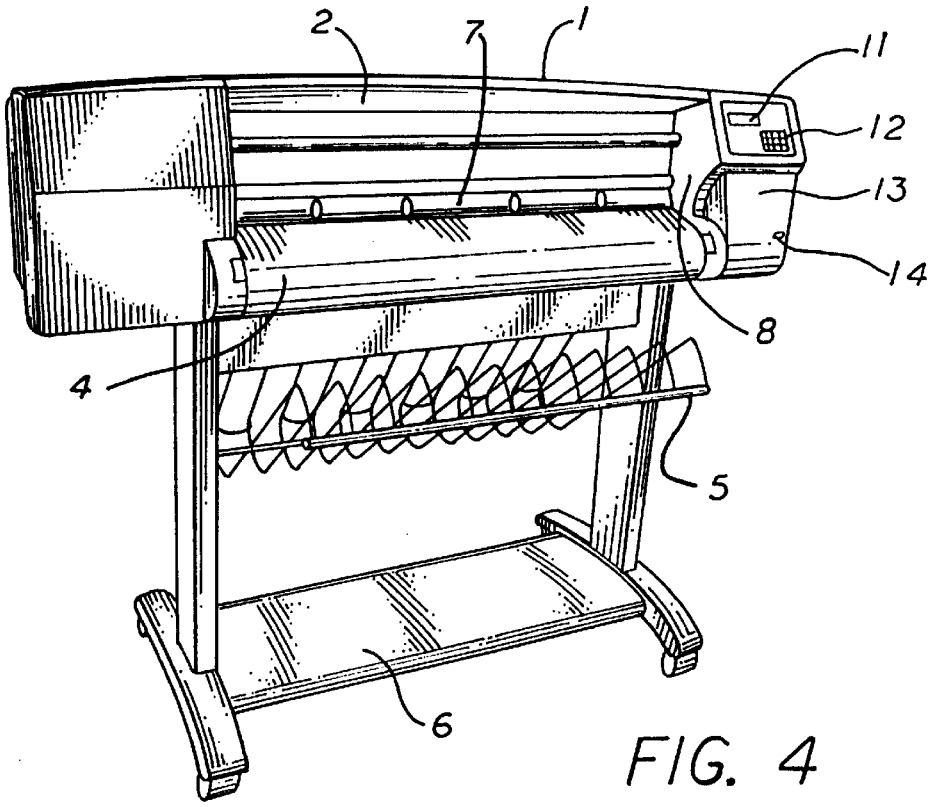
FIG. 4 is a perspective or isometric view, taken from the left and slightly above, of an inkjet printer/plotter that may embody preferred forms of the invention.

For purposes only of definiteness, this description is couched in terms of an inkjet pen 26 (FIG. 1) with multiple nozzles 126. As stated previously the invention is applicable to many other kinds of printing elements and printheads—including but not necessarily limited to those listed in the "BACKGROUND OF THE INVENTION" section.

Thus the invention is not necessarily limited to printers that dispense ink as such, but rather is applicable to many other forms of colorant. Moreover the invention is not necessarily limited to printing on the most conventional sorts of printing media such as paper, plastic sheeting and the like; to the contrary it can be used in machines that perform incremental printing on virtually any medium including clothing, cloth, food, wood, metal, glass or other ceramics, billboards, etc.

As noted earlier the invention may be embodied in a system that operates in a single-pass mode with respect to an entire image—bar-code printers; heat-transfer printing in a FAX machine; thermal printers for small receipts or expiration-date labels, or ATM-machine information slips. The type of system in use does limit the forms of the present invention that are applicable.

Those skilled in the art will understand how to interpret the following discussion and associated drawings with respect to these many other types of printing devices and printed images.

This description is based on the assumption that the nozzles extend from a first or highest nozzle 123 to a last or lowest nozzle 124, which may be in plural rows as illustrated or in a single row or multiple rows as preferred. The nozzles include at least one nozzle 127 that is subject to failure.

If that one nozzle in fact becomes a failed nozzle 127' (middle view of FIG. 1), then the invention provides several ways to conceal the consequences of the failure—without giving up the benefits of single-pass operation. It will be assumed that at least one nearby nozzle (preferably an adjacent one 125) will remain in operation.

1. Pen Crop

This approach 87 (FIG. 8) declares a segment 129 (FIG. 1) of the pen inoperative, and takes that segment out of service. The segment thus inactivated extends from the position 128 of the failed nozzle 127', through the last nozzle 124 in the near end of the pen.

In the illustrated case, since the failed nozzle 127' is nearer the bottom of the pen than the top, the "near end" of the pen is at the bottom, and the inactivated segment 129 accordingly runs from the failed-nozzle position 128 through the last nozzle 124 at the bottom of the pen, inclusive. The nozzles remaining in service thus occupy the segment from the topmost nozzle 123 through the previously mentioned "adjacent" nozzle 125, inclusive.

These nozzles 123 through 125 can then be used 88 (FIG. 8) as if they were an entire pen 26', as shown in the right-hand view of FIG. 1—but one having fewer nozzles than the original entire pen 26. Those skilled in the art will understand that in general this change will call into play some degree of modified simple "printmasking" (i. e. simple assignments of sequential nozzles to successive pixel rows within each swath), in turn including a corresponding adjustment 89 of the printing-medium advance distance.

In particular, other pens may have to be adjusted in length to match the shortest one; this consideration applies particularly in the case of multipen systems used for printing colors. In some cases it is possible to operate pens of different lengths together, as taught for instance in the Nicoloff patent document mentioned previously; however, this is generally somewhat awkward for single-pass systems.

In the worst case, the failed nozzle may be at the center of the pen, leading to throughput comparable with that of a two-pass printmode—and possibly with lesser quality of the resulting image. In many or most cases, however, a failed nozzle is at least some significant fractional distance along the pen from the center, and at best only a few working nozzles go unused.

For example, consider a pen that has 512 nozzles, which we can suppose to be numbered from one through 512. Assume that a nozzle fails in the 483rd position. Now the zone 129 (FIG. 1) that is to be disregarded—i. e., inactivated—extends from the 483rd nozzle through the 512th nozzle inclusive, or in other words thirty nozzles along the pen.

Printing continues with the remaining nozzles from the first through the 482nd—or, in other words, as if a pen with a total of 482 nozzles were in use. The plot will be printed in roughly 512/482=1.06 times the duration with no nozzles out. This six-percent increase is almost unnoticeable, and the printing proceeds with no nozzles out in this shortened or cropped pen.

In effect, with respect to throughput this algorithm is closely analogous to having nonintegral-pass printmodes—or in other words "1.xx-pass" printmodes, where here the "xx" (in the preceding example "06") represents the fractional excess above unity found by dividing the original pen complement by the cropped-pen complement.

2. Composite-Black Substitution

This approach 86 (FIG. 8) is best appreciated by considering a series of alphanumeric characters 231 (FIG. 2), such as for example the numerals "38", which a printer is being used to print. For explanatory purposes it is assumed that some of the nozzles 126 (FIG. 1) are printing these characters 231 in a single-pass mode—and that the nozzle 127 (FIG. 1) which will be subject to failure is assigned to print particular horizontal bars 227 which form part of these characters.

When that nozzle actually becomes a failed nozzle 127' (FIG. 1), the result is that the printout contains a blank line 227' (upper right-hand view, FIG. 2) where the bar 227 should be. The invention overcomes this without resort to plural-pass operation, and in particular does so by simply substituting bars 227" printed in composite black.

In other words subtractive primary colors such as the conventional cyan, magenta and yellow are overprinted to form the bars 227". In essence the corresponding nozzles of the color pens are treated as redundant printing mechanisms for the otherwise-unavailable pixel row.

Particularly for line drawings no degradation of print quality should normally result even if the composite black is colorimetrically imperfect. It is difficult for the eye to detect small colorimetric errors in features that subtend only a very small visual angle in one or another direction, such as for instance a line that is just one or two pixels wide. It is desirable that the pens be well aligned with one another and the redundant color nozzles well directed—i. e., aimed correctly More geneerally the horizontal bar 227 may be a feature of a diagram, for instance a wall in a floor plan as suggested earlier. Many other critical portions of images, such as for instance dimension lines (usually quite thin) in engineering drawings, can benefit from composite-black substitution for a failed black-printing nozzle.

Although this strategy of the invention has been described in terms of inkjet printing, it can be implemented by other systems capable of single-pass color printing, if different apparatus is used for the different colors at each pixel row. For example, a dot-matrix printer whose ribbons and other operating features are arranged to print color in a single pass can be employed to practice this strategy of the invention, provided that the printer does not use the same printing pin(s) for the same pixel row in chromatic colors as used for black.

3. Plural-Common-Base-Color-Printhead Substitution

This approach 86' (FIG. 8) is understood from the same numeric characters 231 illustrated in FIG. 2, with only the difference that the substitute bars 227" now are printed by other printheads (e. g. inkjet pens) that print the same base color. As explained earlier, the other head that is used for this purpose is either (1) a printhead that prints a different dilution or intensity of that same base color, or (2) a printhead on a different carriage that ordinarily serves a different segment of the image than the particular printhead whose element has failed.

The phrase "base color", as set forth previously, means either one of the chromatic colors (such as cyan, magenta and yellow) that is in use in the printer, or black. What is important is simply that the base color of the substitute be the same as the base color of the failed printing element, so that the substitution produces a reasonable approximation to the originally intended image feature, on the pixel row of interest.

4. Nearby Replacement

The same problem shown in the upper two views of FIG. 2 is repeated in the upper two views of FIG. 3, with respect to the alphanumeric characters 231 (FIG. 2)—with the nozzle 127 (FIG. 1) which will be subject to failure again assigned to print certain horizontal bars 227.

When that element 127 becomes a failed nozzle 127' (FIG. 1), as before the printout contains a blank line 227' (upper right-hand view, FIG. 3) in place of the bar 227, and the invention overcomes this without resort to plural-pass operation. In the present case, however, the invention does so by substituting 85 (FIG. 8) bars 225 (lower right view, FIG. 3) printed by a nearby nozzle 125 (FIG. 1).

Preferably the nozzle that is thus pressed into service is an immediately adjacent nozzle as indicated. Even using an adjacent nozzle, this tactic does incur some distortion—as shown in the lower view of FIG. 3. The adjacent nozzle cannot produce a bar exactly where it should be, but can print a bar that is only one pixel out of position.

Of course if a nearby but more-remote nozzle must be used the distortion is typically more severe. Depending on the size and character of the features involved, some limit can be placed on the remoteness of substitute nozzles that remains acceptable.

4. The "Determining" Function

Determination 72 (FIG. 8) of failed nozzles can be either user-triggered semimanually 15, 67, 84 based on a diagnostic plot generated 81 through commands 63 to the final output stage of the printer, or obtained by a procedure 81–83 that is automatic. In the latter case, the system acquires either 82 data 64 from a sensor e. g. 52' reading a similar diagnostic test pattern or 83 detection data 65 developed from inkdrops in flight.

Various diagnostic printout protocols have been developed. One such protocol generates a separate, discrete machine-readable and visually perceptible test pattern for each nozzle (or other printing element)—as described in the previously mentioned copending patent document of Armijo et al.

The diagnostic pattern of Armijo straightforwardly provides information about nozzles that have failed. It appears adaptable to determination of nozzle misdirection as well, for use in those situations (see the two preceding subsections) in which nozzle substitutions are made.

Although a misdirected nozzle cannot be fixed by software, in many cases a choice of substitutions may be available. An upper-adjacent nozzle that is misdirected upward may not be as desirable a choice as a lower-adjacent nozzle that is also misdirected upward. Those skilled in the art will appreciate that the decision actually depends on the magnitudes of the two aiming errors.

In determining nozzles that are out, to maintain more fully automatic operation it is preferable to provide optical sensing equipment. The previously mentioned patent document of Schmidt teaches a sensor particularly suited for use in a scanner, and readily commandeered for determining presence and positions of small printed test patterns—such as Armijo's. Another approach that printed a pattern on a printing medium, and now may perhaps be regarded as relatively slow, is taught in the Cobbs patent document mentioned earlier.

The patent document of Baker teaches sensor mounting and excitation innovations specifically developed for colorimetric analysis but easily capable of fine positional measurements. Those of Bruch and of Dr. Ix teach respective optical hardware systems for reading ink-flight geometries directly. The Ix system in particular could require modification to enable its use to determine nozzle aiming (i. e., as well as nozzle failures).

Bruch's sensor and methodology enable identification—within about five seconds—of all the nozzles that are out of service. (Such performance is faster than an earlier approach that waited to detect drops before firing more drops.) This is accomplished by firing of drops very fast, at about twelve kilohertz, and sampling digitally (based on a threshold) at approximately forty kilohertz.

5. Hardware (Including Algorithmic Modules) for Implementing the Invention

The invention is now most preferably implemented in a printer/plotter that includes a main case 1 (FIG. 4) with a window 2, and a left-hand pod 3 that encloses one end of the chassis. Within that enclosure are carriage-support and -drive mechanics and one end of the printing-medium advance mechanism, as well as a pen-refill station with supplemental ink cartridges.

The printer/plotter also includes a printing-medium roll cover 4, and a receiving bin 5 for lengths or sheets of printing medium on which images have been formed, and which have been ejected from the machine. A bottom brace and storage shelf 6 spans the legs which support the two ends of the case 1.

Just above the print-medium cover 4 is an entry slot 7 for receipt of continuous lengths of printing medium 4. Also included are a lever 8 for control of the gripping of the print medium by the machine.

A front-panel display 11 and controls 19 are mounted in the skin of the right-hand pod 13. That pod encloses the right end of the carriage mechanics and of the medium advance mechanism, and also a printhead cleaning station. Near the bottom of the right-hand pod for readiest access is a standby switch 14.

Figure 5:
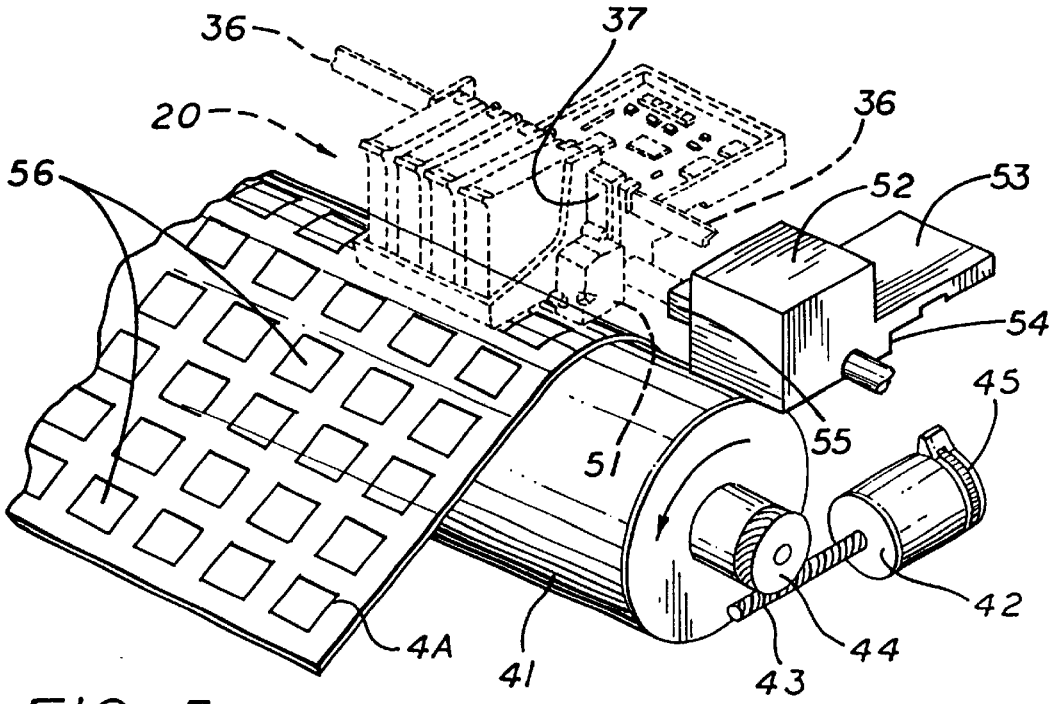
FIG. 5 is a like view but enlarged and taken from above right, and showing representative sensors, test pattern, pen carriage with printheads, auxiliary sensor carriage, and printing-medium platen—all within the FIG. 4 printer/plotter.

Within the case 1 and pods 3, 13 a cylindrical platen 41 (FIG. 5)—driven by a motor 42, worm 43 and worm gear 44 under control of signals from a digital electronic processor—rotates to drive sheets or lengths of printing medium 4A in a medium-advance direction. Print medium 4A is thereby drawn out of the print-medium roll cover 4.

Meanwhile a pen-holding carriage assembly 20 carries pens back and forth across the printing medium, along a scanning track—perpendicular to the medium-advance direction—while the pens eject ink. The medium 4A thus receives inkdrops for formation of a desired image, and is ejected into the print-medium bin 5.

As indicated in the drawing, the image may be a test pattern of numerous color patches or swatches 56, for reading by a color sensor to generate calibration data. For present purposes, such colorimetric test patterns are replaced 81 (FIG. 8) by much simpler linework diagnostics (such as for instance those of Armijo) for detecting failed nozzles—and preferably also positioning errors.

A small automatic optoelectronic sensor 51 rides with the pens on the carriage and is directed downward to obtain data about pen condition (nozzle firing volume and direction, and interpen alignment). In a printer with a simple densitometric system, this same sensor 51 may perform the necessary optical measurements for the densitometry too—or even, as explained in the above-mentioned patent document of Baker, for use as a colorimetric sensor. Although the sensor in such applications is particularly compact and lightweight, it does require a somewhat larger enclosure 51 than suggested in FIG. 5.

Other aspects of the Baker invention use instead an auxiliary colorimeter carriage 52. This carriage houses a colorimetric sensor that is distinct from the pen-function sensor 51 but can be secured next to it by a coupling 55—or decoupled for parking, as illustrated, at the edge of the platen 41.

As will now be evident to those skilled in the art, either the small onboard sensor 51 or the larger auxiliary-carriage module 52 can readily perform optical measurements 82 (FIG. 8) such as needed for the "determining" function of the present invention. Suitable algorithmic control 82 is well within the skill of the art, and may be guided by the discussions in the present document.

A very finely graduated encoder strip 36 is extended taut along the scanning path of the carriage assembly 20 and read by another, very small automatic optoelectronic sensor 37 to provide position and speed information 37B for the microprocessor. One advantageous location for the encoder strip 36 is immediately behind the pens.

Figure 6:
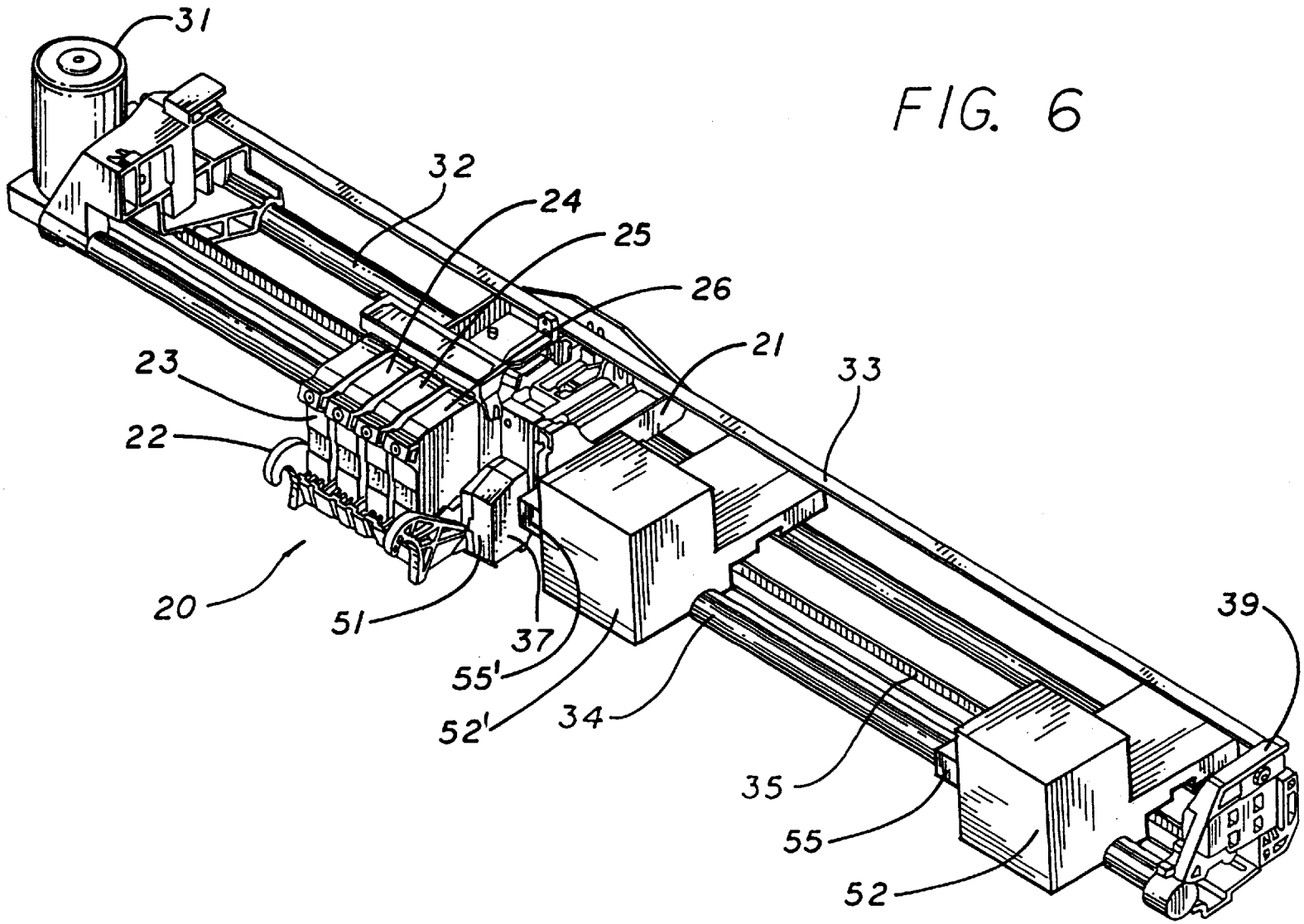
FIG. 6 is a like view, but less enlarged, of the FIG. 5 pen-carriage and auxiliary sensor carriage, with the carriage suspension and drive system.

A currently preferred position for the encoder strip 33 (FIG. 6), however, is near the rear of the pen-carriage tray—remote from the space into which a user's hands are inserted for servicing of the pen refill cartridges. For either position, the sensor 37 is disposed with its optical beam passing through orifices or transparent portions of a scale formed in the strip.

The pen-carriage assembly 20 is driven in reciprocation by a motor 31—along dual support and guide rails 32, 34—through the intermediary of a drive belt 35. The motor 31 is under the control of signals from the digital processor.

Likewise the auxiliary, colorimeter carriage and enclosure 52—present only in the alternative embodiment as explained above—rests on both rails 32, 34, whether parked next to the right end bracket 39 of the scan assembly or, if in use, coupled to the pen carriage 20 as shown at 52'. (In FIG. 6 the callout for the colorimeter carriage/housing shown adjacent to the pen carriage 20 is marked with a "prime" symbol thus, 52', to emphasize that there is actually only one colorimeter carriage, not two as might otherwise be supposed from the drawing.)

Naturally the pen-carriage assembly includes a forward bay structure 22 for pens—preferably at least four pens 23–26 holding ink of four different colors respectively. Most typically the inks are yellow in the leftmost pen 23, then cyan 24, magenta 25 and black 26; and this would be one configuration in which the composite-black replacement technique would be applicable.

Another increasingly common system, however, has inks of different colors that are actually different dilutions for one or more common chromatic colors, in the several pens. Thus different dilutions of black may be in the several pens 23–26—and this would be a configuration in which the plural-black substitution technique would apply. As a practical matter, both plural-chromatic-color and plural-black pens may be in a single printer, either in a common carriage or plural carriages.

Also included in the pen-carriage assembly 20 is a rear tray 21 carrying various electronics. The colorimeter carriage too has a rear tray or extension 53 (FIG. 2), with a step 54 to clear the drive cables 35.

In a block diagrammatic showing, the pen-carriage assembly is represented separately at 20 (FIG. 7) when traveling to the left 16 while discharging ink 18, and at 20' when traveling to the right 17 while discharging ink 19. It will be understood that both 20 and 20' represent the same pen carriage.

The previously mentioned digital processor 91 provides control signals 20B to fire the pens with correct timing, coordinated with platen drive control signals 42A to the platen motor 42, and carriage drive control signals 31A to the carriage drive motor 31. The processor 91 develops these carriage drive signals 31A based partly upon information about the carriage speed and position derived from the encoder signals 37B provided by the encoder 37.

(In the block diagram all illustrated signals are flowing from left to right except the information 37B fed back from the sensor—as indicated by the associated leftward arrow.) The codestrip 33 thus enables formation of color inkdrops at ultrahigh precision during scanning of the carriage assembly 20 in each direction—i. e., either left to right (forward 20') or right to left (back 20).

Figure 7:
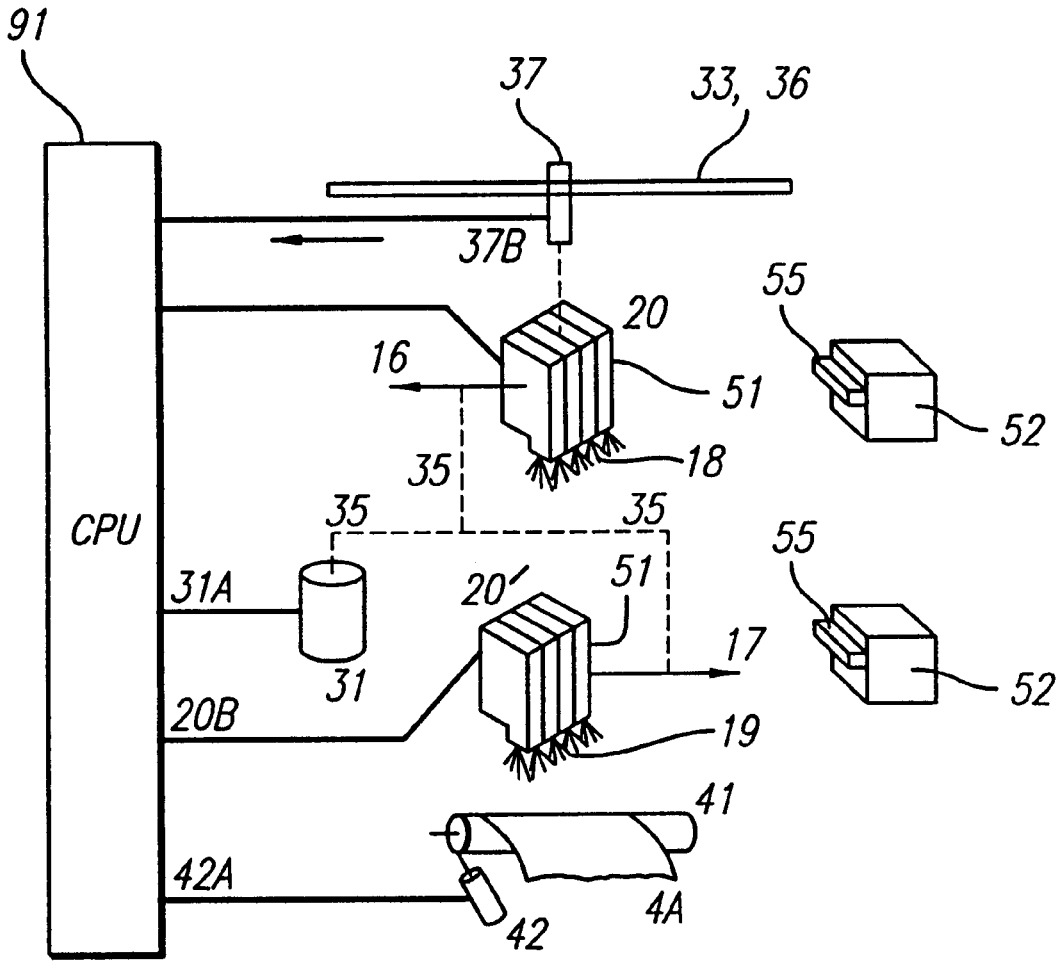
FIG. 7 is a highly schematic diagrammatic representation of a hardware system according to the invention, and particularly with the auxiliary sensor carriage parked.

As the block diagram suggests, the auxiliary sensor or colorimeter carriage 52 preferably remains decoupled from the pen carriage 20 and parked at right regardless of pen-carriage direction, in the writing mode of FIG. 7. This includes writing 81 (FIG. 8) test pattern color patches 56 such as noted earlier in FIG. 5, and nozzle-out or nozzle-aiming diagnostics (not shown) such as taught by Armijo—if indeed it is the colorimeter module 52 that is selected for this function.

In colorimetric-data reading mode 82 (FIG. 8), however—that is, when reading those same patches 56 or nozzle diagnostics, the pens are turned off. If the auxiliary module 52 is to be used for reading the diagnostic patterns, the pen carriage first moves next to the auxiliary sensor carriage 52' (FIG. 8) and the two are then coupled together. The pen carriage and its drive and position/speed-monitoring subsystems can then be brought to bear in positioning the colorimeter carriage, and the two carriages move together.

While the pens remain turned off, as indicated in this second block diagram the pen carriage moves 16 the auxiliary carriage, relatively slowly, from its parked position to positions above all the patches 56 or—for present purposes—the diagnostic patterns, in turn. This requires coordination with position of the platen 41 and printing medium 4A, to reach the several rows of patches (FIG. 5) or several portions of the diagnostic.

Depending on the order in which the patches or diagnostics are read, the carriages may be called upon to reciprocate during the reading mode. When the reading is complete for all portions of the printout, if the colorimeter module 52 has been in use the pen carriage moves 17 the colorimeter carriage 52 back to its parking position at the right.

Alternatively as mentioned previously the system either ejects inkdrops that are detected directly 83, for example by a drop sensor such as taught by Bruch or by Dr. Ix, or is simply directed by an operator to print the diagnostic patterns. In the latter case the operator then reads these patterns visually to determine what nozzles have failed—and the operator keys in identification 15 (FIG. 8) of the failed nozzles, while the system receives 84 these data 67 for use in accommodation of those failures.

Through any of these procedures the system thus identifies the failed nozzles, and stores this information for subsequent use in preservation of single-pass printing modes. Once that has been done, the system is ready for routine single-pass printing as shown in the lower left-hand portions of the integrated-circuit block 79 (FIG. 8).

New image data 71 are received 91 into an image-processing stage 73, which may conventionally include a contrast and color adjustment or correction module 76 and a rendition, scaling etc. module 77. Although the present invention relates to single-pass operation, the invention perhaps most typically operates in a printer that is also capable of multipass operation.

Figure 8:
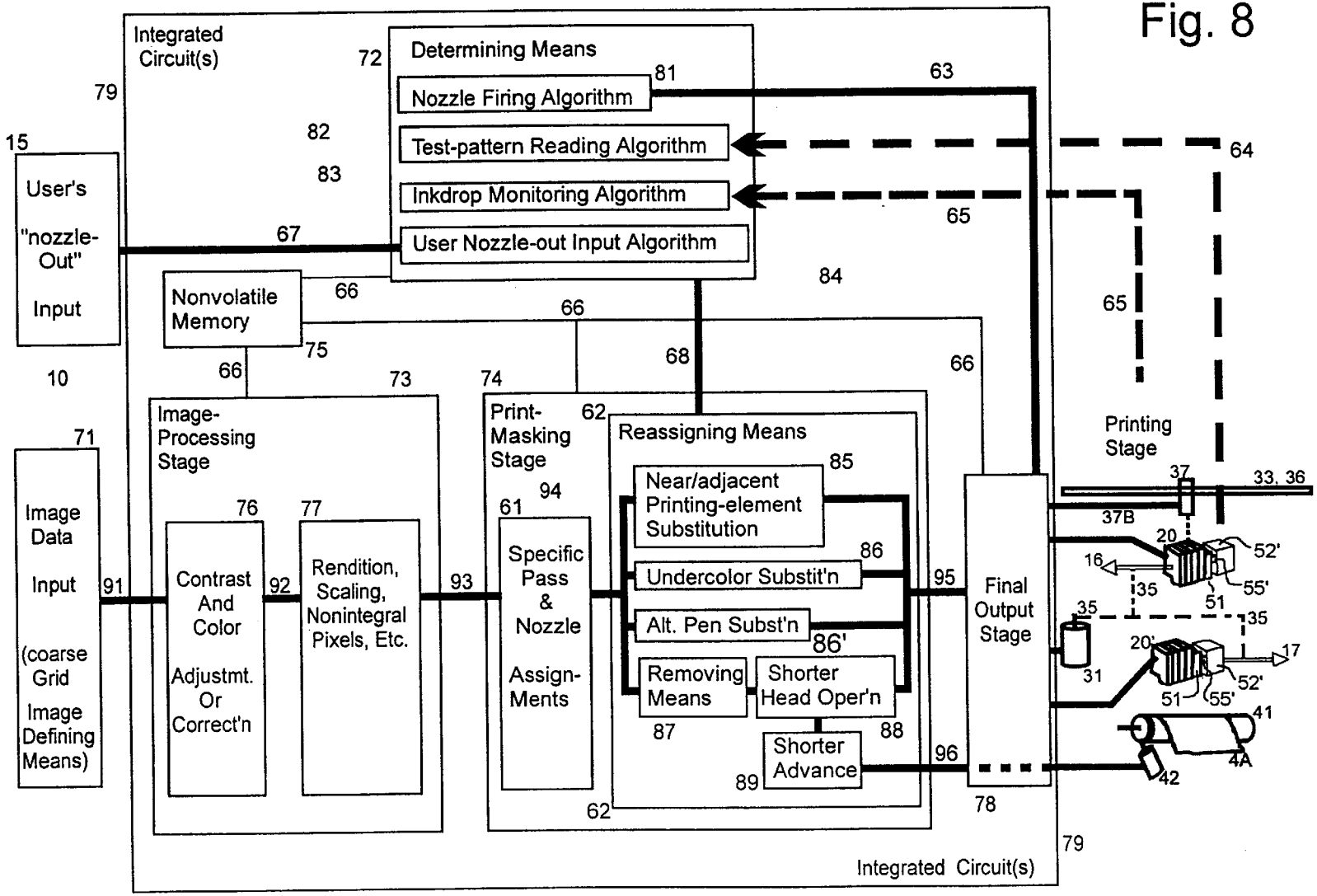
FIG. 8 is a like diagram showing the integrated-circuit portions of the system in much greater detail, and with the auxiliary sensor carriage coupled to the pen carriage for use.

For this reason FIG. 8 shows that information 93 passing from the image-processing modules next enters a printmasking module 74. This may include a generally conventional stage 61 for specific pass and nozzle assignments; however, in operation of the present invention the pass and nozzle "assignments" are essentially trivial since there is to be only one pass, and the nozzles must be assigned in a substantially sequential fashion to the successive pixel rows of the intended printout.

Such a stage 61 thus is virtually a pass-through operation, but may in effect prepare what might be called a "draft" of the printmasking that will be employed. That preliminary approximation can then be modified by the reassigning means 62 also within the printmasking stage.

The printmasking stage 74 alternatively may be conceptualized as a single module that simply assigns available functioning nozzles. That assignment is performed according to the reassignment stratagems already described in subsections 1 through 3 above, to the pixel rows of each swath.

Depending upon the system resources available, the data 93, 94 entering the reassigning means are directed to diverging paths into the previously introduced modules 85–89. Those skilled in the art will appreciate that in some printers all these modules are available for automatic selection as appropriate, whereas in other printers only certain of these modules may be available—for example, only near-element substitution 85 for a small thermal or dot-matrix printer in an ATM.

The paths reconverge 95 for passage to the final output stage 78 of the printer, where command signals are developed for direct control of the printing stage. The entire system operates automatically based upon instructions held in a nonvolatile memory 75 and distributed 66 to all the functioning modules.

As is well known, the integrated circuits may be part of the printer itself, as for example an application-specific integrated circuit (ASIC), or may be program data in a read-only memory (ROM)—or during operation may be parts of a programmed configuration of operating modules in the central processing unit (CPU) of a general-purpose computer that reads instructions from a hard drive. Most commonly the circuits are shared among two or more of these kinds of devices. Most modernly, yet another alternative is a separate stand-alone product, such as for example a so-called "raster image processor" (RIP), used to avoid overcommitting either the computer or the printer.

6. The Method

Figure 9:
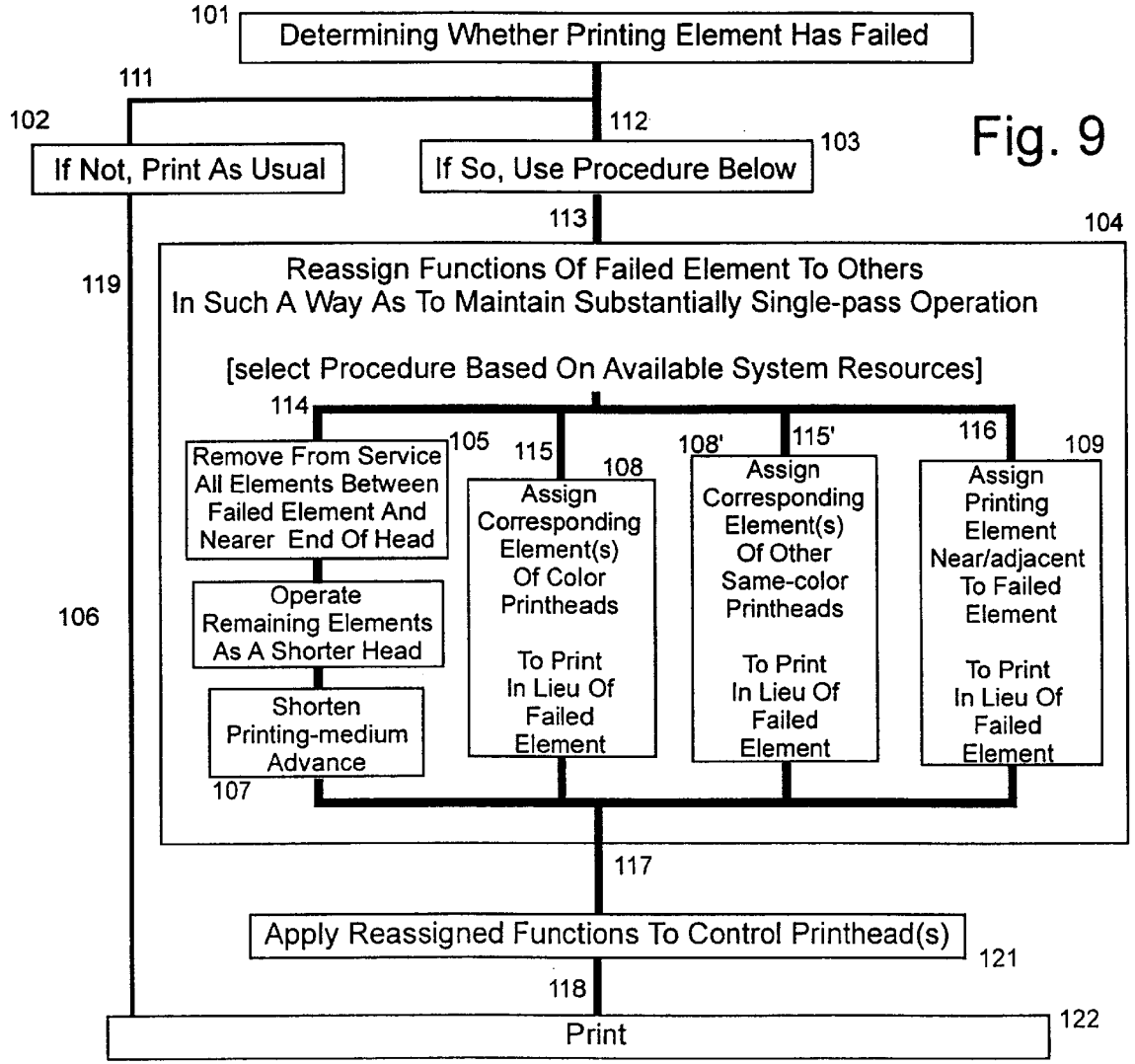
FIG. 9 is a flow chart of method aspects of the invention.

Expressing the foregoing hardware-based functionalities in method terms, the first step is determining 101 (FIG. 9) whether a printing element has failed. If not, then the system operation branches 111 to a decisional step 102 in favor of printing as usual—and this decision leads 119 to the printing step 122 directly.

On the other hand, if a printing element has failed then operation instead branches 112 to a decision 103 in favor of the special reassignment procedures 104 of the present invention. Depending upon system resources, these procedures 104 may diverge to two or more paths 114–116 for dealing with various failures appropriately, or may select just one of those paths.

One procedural path 114 may pursue the pen-crop strategy 105–107. Another path 115 may lead to composite-black substitution 108, yet another 115' to plural-common-base-color replacement 108', and still another 116 to the previously described near-element substitution 109.

It will be appreciated by those skilled in the art that this decision can be performed semiindependently for each of several failed elements—for instance handling one failure, or two failures near opposite ends of the pen, by the pen-crop approach, and then proceeding to cover other failures in the same pen by the composite-black, or plural-common-base-color, or nearby-element substitution method.

In any event these paths reconverge 117 for actual application 121 of the reassigned functions to control the printhead or printheads. This application then leads 118 directly to the final step, printing 122 of the desired image.

The above disclosure is intended as merely exemplary, and not to limit the scope of the invention—which is to be determined by reference to the appended claims.

What is claimed is:

1. A method of printing desired images on a printing medium, by construction from individual marks formed by at least one scanning multiple-printing-element printhead that operates in substantially a single-pass mode of operation and without duplicate nozzles in tandem along a scanning direction; said method comprising the steps of:

determining whether any printing element of the printhead has failed; and if a printing element has failed, then reassigning functions of the failed printing element to other printing elements in such a way as to maintain the substantially single-pass mode of operation.

2. The method of claim 1, further comprising the step of:

applying the reassigned functions to control operation of the at least one printhead, to print the desired images on the printing medium.

3. The method of claim 1, wherein:

the reassigning step comprises assigning a printing element near the failed printing element, to print in lieu of the failed printing element.

4. The method of claim 3, wherein:

the printing element near the failed printing element is immediately adjacent to the failed printing element.

5. A method of printing desired images on a printing medium, by construction from individual marks formed by at least one scanning multiple-printing-element printhead that operates in substantially a single-pass mode of operation; said method comprising the steps of:

determining whether any printing element of the printhead has failed; and if a printing element has failed, then reassigning functions of the failed printing element to other printing elements in such a way as to maintain the substantially single-pass mode of operation; and wherein:

the reassigning step comprises removing from service all printing elements between the failed printing element and a nearer end of the printhead, inclusive.

6. The method of claim 5, wherein:

the reassigning step further comprises the step of then operating all remaining in-service printing elements as a shorter printhead.

7. The method of claim 6, particularly for use with such a printhead that operates in conjunction with a printing-medium advance mechanism, and further comprising the step of:

shortening each operation of the printing-medium advance mechanism to correspond to a height of the shorter printhead.

8. Apparatus for printing desired images on a printing medium, by construction from individual marks formed by at least one scanning multiple-printing-element printhead, without duplicate nozzles in tandem along a scanning direction; said apparatus comprising:

means for determining whether any printing element of the printhead has failed; and means for, if a printing element has failed, then reassigning functions of the failed printing element to other printing elements in such a way as to maintain the substantially single-pass mode of operation.

9. The apparatus of claim 8, further comprising:

nonvolatile memory for holding instructions for automatic operation of the determining and reassigning means.

10. The apparatus of claim 8, wherein:

the reassigning means comprise means for assigning a printing element near the failed printing element, to print in lieu of the failed printing element.

11. The apparatus of claim 10, wherein:

the printing element near the failed printing element is immediately adjacent to the failed printing element.

12. Apparatus for printing desired images on a printing medium, by construction from individual marks formed by at least one scanning multiple-printing-element printhead; said apparatus comprising:

means for determining whether any printing element of the printhead has failed; and means for, if a printing element has failed, then reassigning functions of the failed printing element to other printing elements in such a way as to maintain the substantially single-pass mode of operation; and wherein:

the reassigning means comprise means for removing from service all printing elements between the failed printing element and a nearer end of the printhead, inclusive.

13. The apparatus of claim 12, wherein:

the reassigning means further comprise means for then operating all remaining in-service printing elements as a shorter printhead.

14. The apparatus of claim 13, further comprising:

a printing-medium advance mechanism; and means for shortening each operation of the printing-medium advance mechanism to correspond to a height of the shorter printhead.

15. A method of printing desired images on a printing medium, by construction from individual marks formed by at least one scanning multiple-printing-element printhead; said method comprising the steps of:

determining whether any printing element of the printhead has failed; and if a printing element has failed, then removing from service all printing elements between the failed printing element and a nearer end of the printhead, inclusive.

16. The method of claim 15, further comprising the step of:

reassigning tasks of the removed-from-service elements for performance by other printing elements of the at least one printhead to print the desired images on the printing medium.

17. The method of claim 15, wherein:

the removing step further comprises the step of then operating all remaining in-service printing elements as a shorter printhead.

18. The method of claim 17, particularly for use with such a printhead that operates in conjunction with a printing-medium advance mechanism, and further comprising the step of:

shortening each operation of the printing-medium advance mechanism to correspond to a height of the shorter printhead.

19. A method of printing desired images on a printing medium, by construction from individual marks formed by at least one scanning multiple-printing-element printhead but no duplicate nozzle in tandem along a scanning direction; said method comprising the steps of:

determining whether any printing element of the at least one printhead has failed; and if a printing element has failed, then assigning a nearby printing element to print in lieu of the failed printing element.

20. The method of claim 19, further comprising the step of:

applying the reassigned functions, to control operation of the at least one printhead to print the desired images on the printing medium.

21. The method of claim 20, wherein:

the nearby printing element is a printing element immediately adjacent to the failed printing element.

* * * * *